US005933997A

United States Patent [19]

Barrett

[11] Patent Number: 5,933,997

[45] Date of Patent: Aug. 10, 1999

[54] ADJUSTABLE COMB APPARATUS

[75] Inventor: David B. Barrett, Salt Lake City, Utah

[73] Assignee: Browning, Morgan, Utah

[21] Appl. No.: 09/139,899

[22] Filed: Aug. 26, 1998

[51] Int. Cl.[6] ..... F41C 23/08

[52] U.S. Cl. ..... 42/73

[58] Field of Search ..... 42/73, 74

[56] References Cited

U.S. PATENT DOCUMENTS

| | | | |
|---|---|---|---|
| 3,710,496 | 1/1973 | Packmayr | 42/73 |
| 4,430,822 | 2/1984 | Fromming et al. | 42/73 |
| 4,589,219 | 5/1986 | Milliman | 42/73 |
| 4,663,877 | 5/1987 | Bragg | 42/74 |
| 4,896,446 | 1/1990 | Gregory | 42/73 |
| 5,031,348 | 7/1991 | Carey | 42/74 |
| 5,075,995 | 12/1991 | Kennel | 42/73 |
| 5,392,553 | 2/1995 | Carey | 42/73 |
| 5,519,957 | 5/1996 | Iannetta | 42/74 |

*Primary Examiner*—Charles T. Jordan
*Assistant Examiner*—Denise J. Buckley
*Attorney, Agent, or Firm*—Foster & Foster

[57] ABSTRACT

An adjustable comb apparatus for firearms involves a base mounted within the stock of a firearm, a pair of servo-clamps adjustably secured within the base, a comb which has a pair of pins which are slidably received by the servo-clamps, and a locking screw which secures the comb at a desired position relative to the firearm stock. The servo-clamps allow the comb to be adjusted simultaneously in a cast direction and in a vertical direction. A single locking screw is rotated to secure the adjustable comb in the desired orientation.

22 Claims, 5 Drawing Sheets

ADJUSTABLE COMB APPARATUS

TECHNICAL FIELD

This invention relates to firearms, and more particularly to combs for firearms.

BACKGROUND OF THE INVENTION

For years, adjustable combs have been utilized in connection with firearms to allow the shooter to quickly place the firearm in a repeatable, predictable shooting position relative to the shooter's body. Typically the shooter will rest his or her cheek against the stock of the firearm when the firearm is mounted and placed in a shooting position. Obviously, there are many different variables that must be accounted for with respect to each shooter. Thus, a preferred comb for firearms will be adjustable according to the particular shooter.

In certain shooting sports, such as the so-called sporting clays, the speed required to mount and aim the firearm is of particular importance. Thus, a preferred comb apparatus will provide the shooter with a fixed and specific structural reference.

Still another major consideration with respect to adjustable combs for firearms relates to the manufacture of standard firearms to meet the needs of individual shooters. A preferred adjustable comb for a firearm will be mass-produced, yet provide enough adjustment options to meet the needs of the many different types and styles of shooters.

Difficulties have persisted, however, with respect to traditional comb devices for firearms. For example, multiple adjustment screws are required. Such adjustment mechanisms are not only cumbersome and difficult to deal with, but they also require that unsightly, additional holes be drilled into the stock. For many gun owners, the beauty of the gun stock, particularly a natural wood stock, is surpassed by no other portion of the firearm.

Still other problems have existed with respect to traditional comb devices. Preferably, the comb will be highly adjustable so that it remains generally parallel to the plane of the fixed stock of the gun. Typically there are multiple attachment locations for an adjustable comb. Therefore, each must be adjusted in a cast direction (i.e., a side-to-side or a left-to-right direction) and in a vertical direction (i.e., an up-and-down direction) and then locked in the appropriate position. Often, the vertical adjustment is lost when the cast adjustment must be made at the same time. Typically multiple locking screws are required to secure the comb in a desired position.

Another problem has persisted with respect to the types of locking systems for traditional adjustable combs. Most traditional systems utilize some type of a locking screw which engages a pin or post coupled to the comb. The posts will slide back and forth within a particular set of receiving slots through which respective set screws are threadedly inserted. When these set screws engage the posts or pins, material deformation occurs. The scarring of the pins will affect the adjustability of the comb. Over time, this material deformation degrades the precision adjustments that can be made to the comb.

Another problem with respect to traditional combs also relates to the material deformation typically required by traditional adjustable combs. Where material deformation is relied upon, repeated shooting of the firearm will inherently result in the comb working its way lose from its mounting arrangement. Overtightening of the set screws will not only result in increased deformation of the material on the posts or pins, but will also stretch the threads of the adjustment screws and result in poor precision of the comb adjustments over time.

In view of the foregoing, a need exists to provide an adjustable comb apparatus for firearms that is easy to adjust, minimizes the number of modifications needed to be made in the stock to accommodate the comb, allows for full adjustment to suit all types of shooters and, requires no deformation of material to lock the comb in place.

SUMMARY AND OBJECTS OF THE INVENTION

It is a primary object of the present invention to provide an adjustable comb apparatus that can be easily adjusted.

Another object of the present invention is to provide an adjustable comb apparatus that can be adjusted in a cast direction and in a vertical direction simultaneously or in each direction independently from one another.

Another object of the present invention is to provide an adjustable comb apparatus that can be locked in a desired position with a single locking screw.

Still another object of the present invention is to provide an adjustable comb apparatus that requires minimal exterior modifications to the firearm stock.

Yet another object of the present invention is to provide an adjustable comb apparatus that can be adjusted in a cast direction without losing a desired vertical adjustment prior to locking the comb in the desired position.

Another object of the present invention is to provide an adjustable comb apparatus that requires no deformation of material to lock the comb in a desired position.

Still another object of the present invention is to provide an adjustable comb apparatus that does not loosen over time, even after repeated shooting of the firearm.

Still another object of the present invention is to provide an adjustable comb apparatus that can be adjusted simultaneously in a cast direction and in a vertical direction and that can lock the comb simultaneously in the cast direction and in the vertical direction.

Another object of the present invention is to provide a detent system for incremental, predictable adjustments in both the cast direction and the vertical direction.

Another object of the invention is to provide an adjustable comb apparatus that will accommodate all different styles and types of shooters.

The foregoing objects are achieved by an adjustable comb apparatus that involves a base mounted in a stock of a firearm, a comb with a pair of sliding pins attached to the comb, a pair of adjustment mechanisms or servo-clamps adjustably disposed within the base, and a lock screw operatively coupled to the adjustment mechanisms to lock the comb in a desired position after it has been adjusted in a cast direction and in a vertical direction.

Other objects, features, and advantages of the invention will become apparent from the following detailed description of the invention with reference to the accompanying drawings.

BRIEF DESCRIPTION OF THE DRAWINGS

Preferred embodiments of the invention are described below with reference to the accompanying drawings.

DETAILED DESCRIPTION OF THE INVENTION

Figure 1:
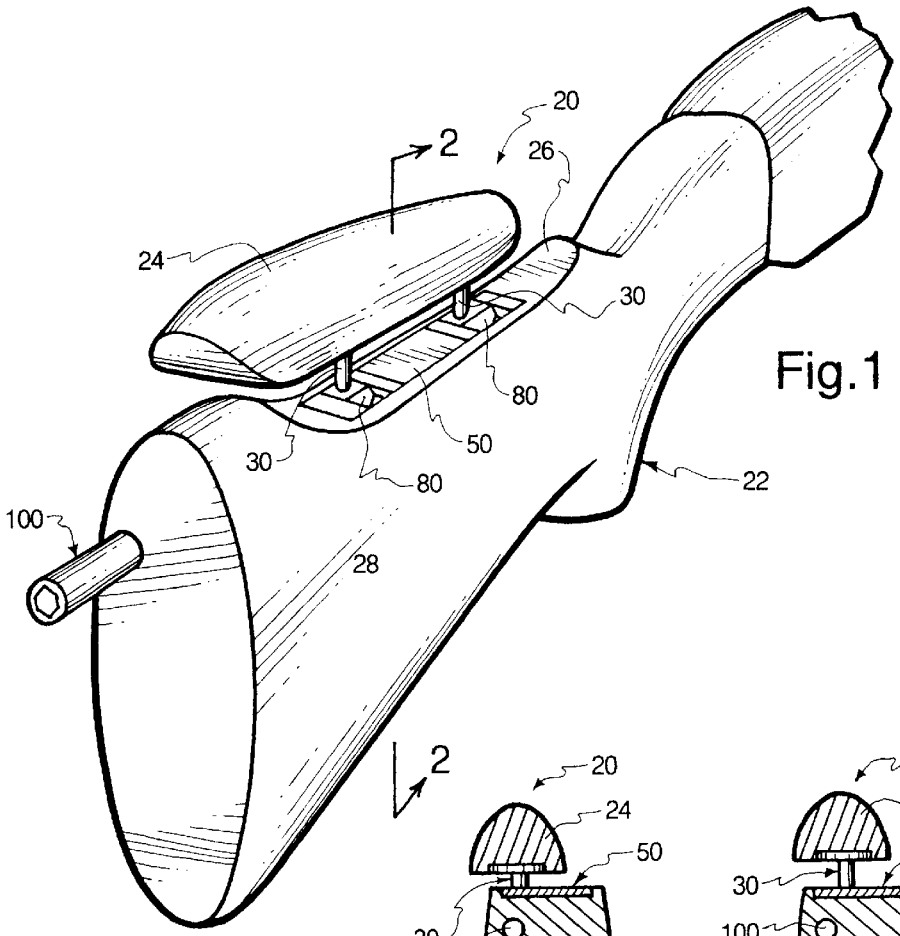
FIG. 1 an isometric view of an adjustable comb apparatus according to the present invention.
Figure 3:
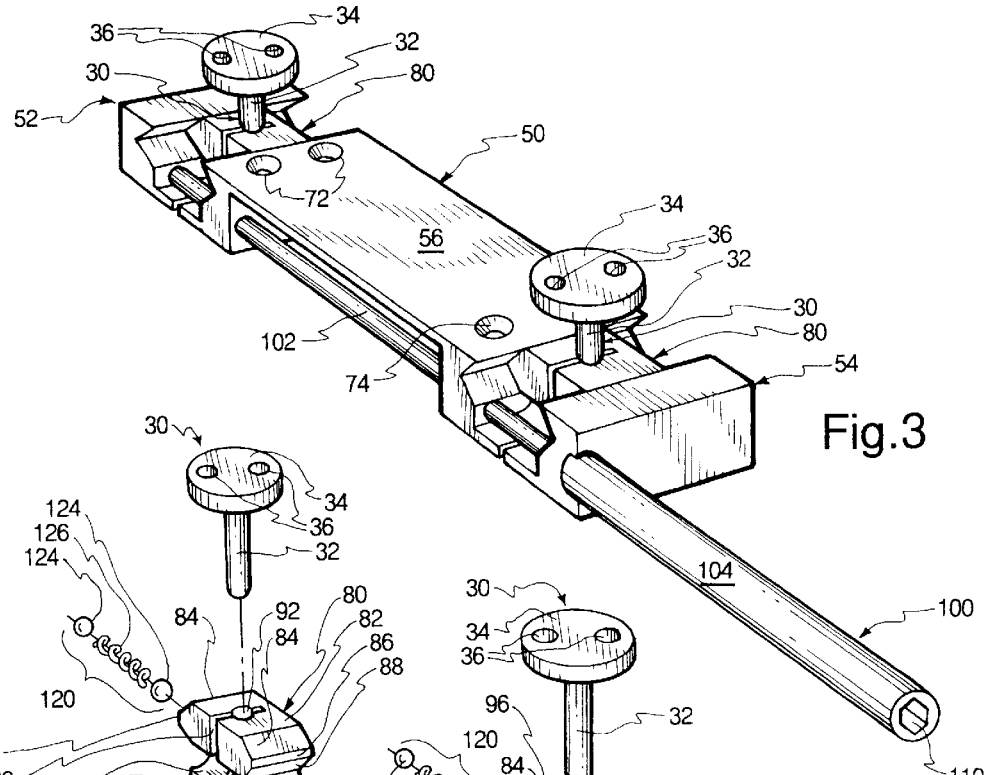
FIG. 3 is an isometric view of the base, the adjustment mechanisms, the locking screw, and the adjustment pins of the adjustable comb apparatus according to the present invention.

As shown generally in FIG. 1, the present invention comprises an adjustable comb apparatus 20 designed to be adjustably mounted on a firearm 22. The adjustable comb apparatus 20 comprises a comb 24 which is sized to fit within a corresponding notched portion 26 formed in the stock 28 of the firearm 22. FIG. 3 shows the comb 24 fully nested within the groove or notch 26 in the firearm stock 28. As will be described in greater detail below, the adjustable comb assembly further comprises a pair of post assemblies 30 coupled to the comb 24, a base assembly 50 mounted within the stock 28 of the firearm 22, a pair of adjustment mechanisms or servo-clamps 80 adjustably mounted within the base 50, and a locking screw 100 which secures the comb 24 in place relative to the firearm 22 after the appropriate adjustments have been made.

Figure 2A:
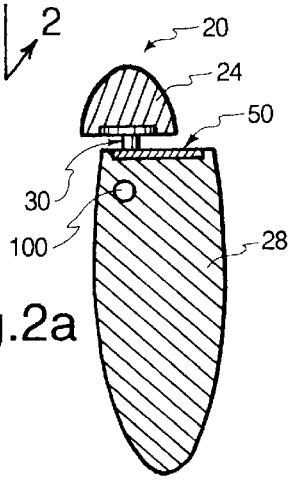
FIGS. 2*a*–2*e* are sectional side elevation views of an adjustable comb apparatus according to the present invention shown schematically with the comb being adjusted in various positions relative to the firearm stock.
Figure 2B:
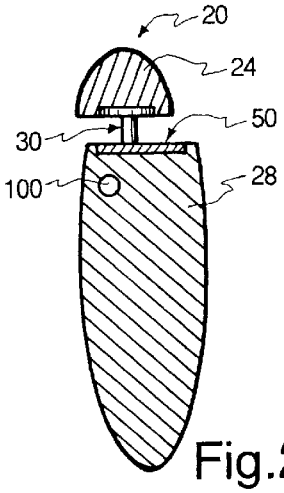
Figure 2C:
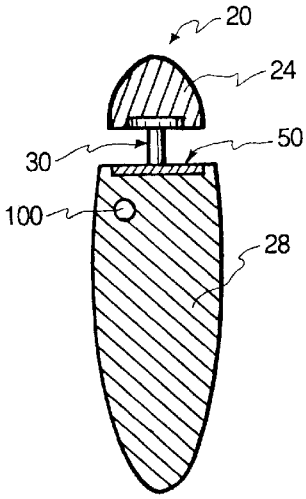
Figure 2D:
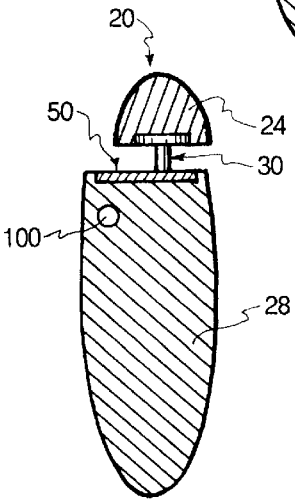
Figure 2E:
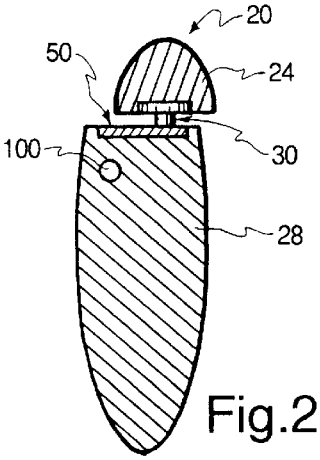

FIGS. 2*a*–2*e* show schematically various positions of the comb 24 relative to the firearm 22 upon making adjustments simultaneously in a cast direction (i.e., in a side-to-side direction or a left-to-right direction) and in a vertical direction (i.e., an up-and-down direction) to the adjustable comb apparatus of the present invention. It is to be understood that the specific adjustments shown in FIGS. 2*a*–2*e* are merely representative of the various positions where the comb can be secured pursuant to utilization of the present invention. FIG. 2*a* generally shows the comb apparatus as being positioned toward the left side of the firearm stock 28 ("left" as shown in schematic FIGS. 2*a*–2*e*). Relative to the position shown in FIG. 2*a*, FIG. 2*b* shows the comb 24 in a higher, more centralized location having been moved in the cast direction and in the vertical direction. FIG. 2*c* shows the comb 24 moved still further in the vertical direction and toward the right in the cast direction so that the comb 24 is positioned so as to be substantially aligned with the stock 28 of the firearm 22. FIG. 2*d* shows the comb 24 being moved downwardly in the vertical direction and still further toward the right side of the firearm stock 28. Finally, FIG. 2*e* shows the comb 24 as having been moved even more toward the right in the cast direction and further downward in the vertical direction.

It is to be understood that the present invention may be utilized with respect to either right-handed firearms or left-handed firearms. The adjustable comb apparatus may be reversed, if necessary, and the adjustment screw 100 may be placed on the opposite side of the firearm stock 28. However, the present invention should enable adjustments of the comb to be made to either side of the firearm stock 28.

It is further to be understood that FIGS. 2*a*–2*e* show the comb 24 being adjusted exclusively in a parallel manner relative to the firearm stock 28, and that offset adjustments of all types can be made within the range of adjustability. That is, the forward portion of the comb 24 could be adjusted to the right or left relative to the rearward portion of the comb 24, or the rearward portion of the comb 24 could be adjusted to the left or right relative to the forward portion of the comb.

With reference to FIGS. 3–4, and 8–17, additional details of the adjustable comb apparatus will be described. The pin or post assemblies 30 comprise a shaft portion 32 and a circular flange portion 34. The flange portion 34 includes a pair of mounting locations 36 through which fasteners may be installed to secure the adjustment pins 30 to the comb (see FIG. 6). Each post contains a plurality of detents 38 (see FIG. 6) that engage a spring-biased ball bearing/spring assembly (described below) so that the adjustable comb apparatus can be adjusted incrementally in the vertical direction.

Figure 7:
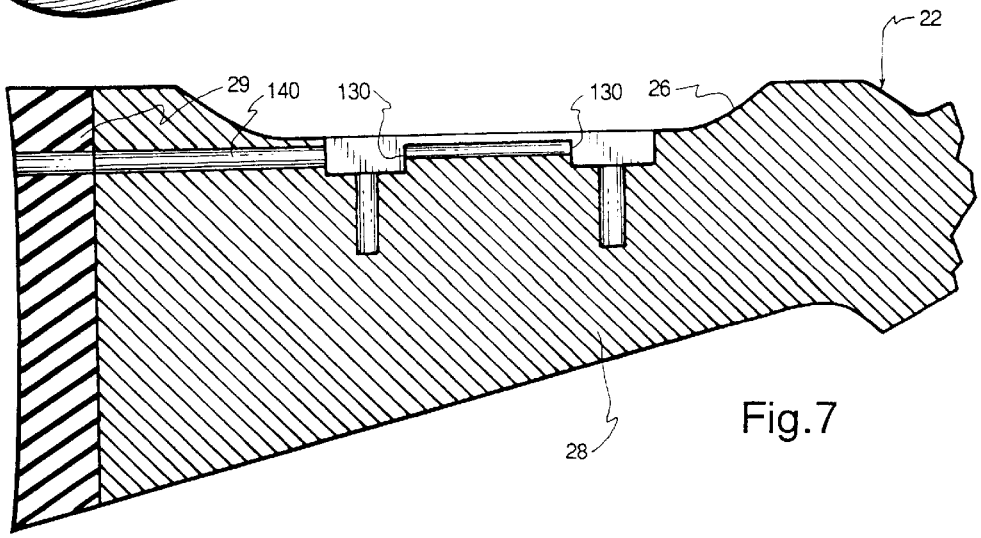
FIG. 7 is a sectional front elevation view, taken along the line 7—7 of FIG. 5, of a stock of a firearm with the appropriate modifications that must be made in the firearm stock and the recoil pad in order to accommodate the adjustable comb apparatus of the present invention.
Figure 8:
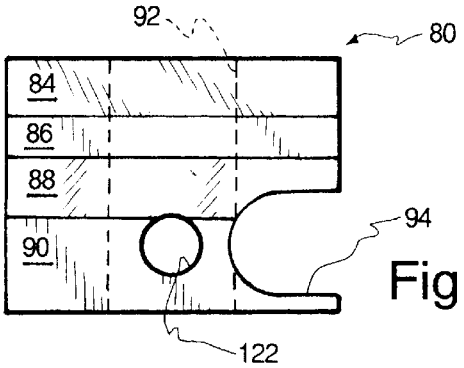
FIG. 8 is a left side elevation view of an adjustment mechanism of the adjustable comb apparatus according to the present invention.
Figure 9:
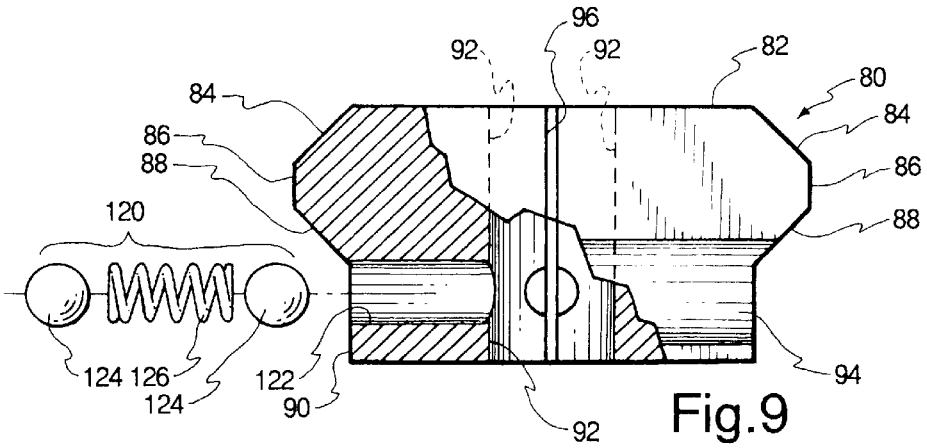
FIG. 9 is a front elevation view of the adjustment mechanism of FIG. 8.
Figure 10:
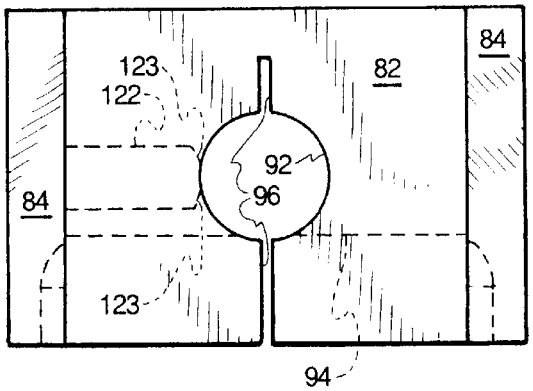
FIG. 10 is a top view of the adjustment mechanism of FIG. 8.
Figure 11:
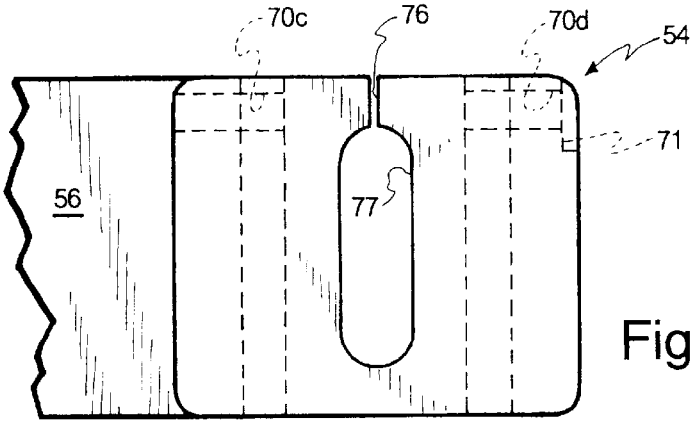
FIG. 11 is a bottom view of the aft portion of the base of the adjustable comb apparatus according to the present invention.
Figure 12:
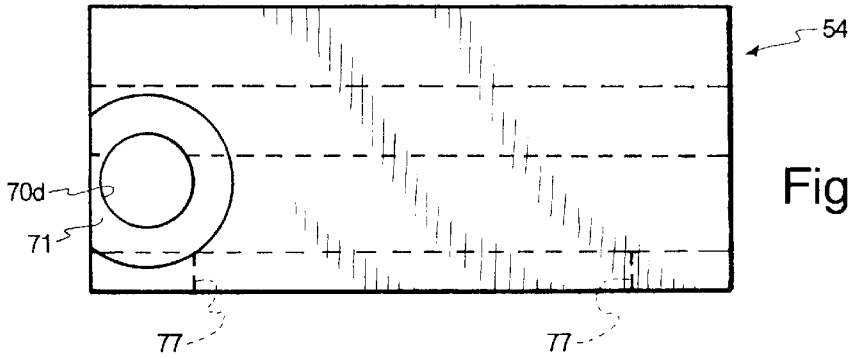
FIG. 12 is a right side elevation view of the base of FIG. 11.
Figure 13:
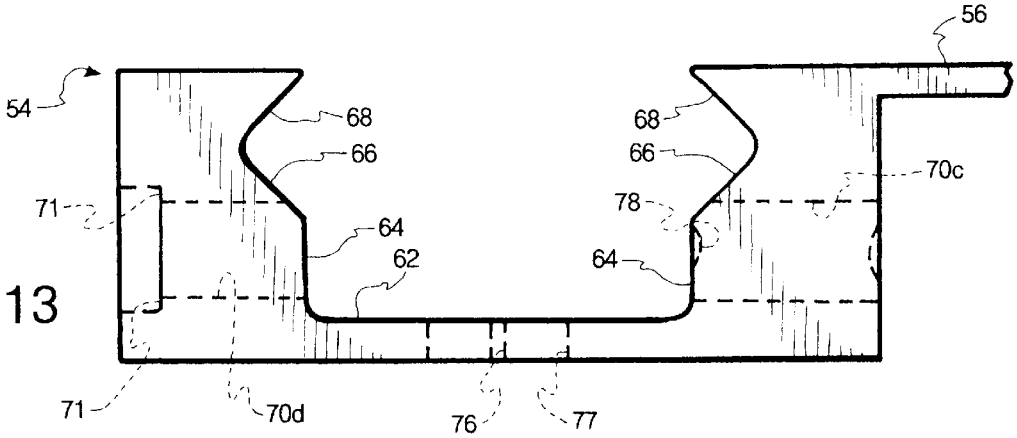
FIG. 13 is a partial rear elevation view, taken along the line 13—13 of FIG. 4, of the portion of the base shown in FIG. 11.
Figure 14:
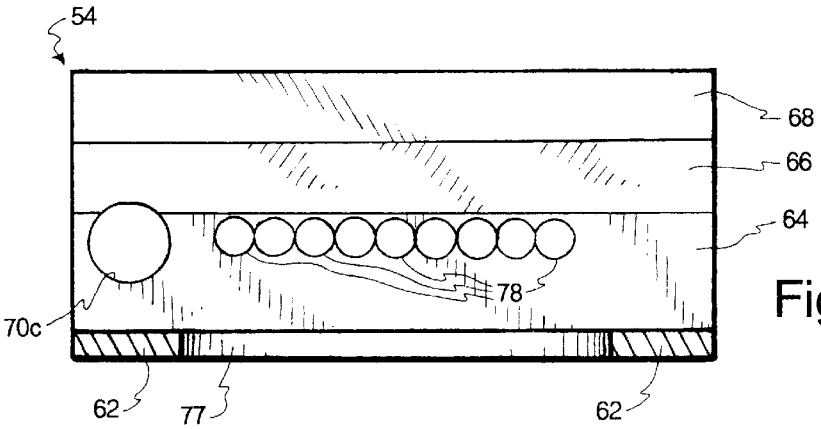
FIG. 14 is a partial right side elevation view, taken along the line 14—14 of FIG. 4, of the base shown in FIG. 12.
Figure 15:
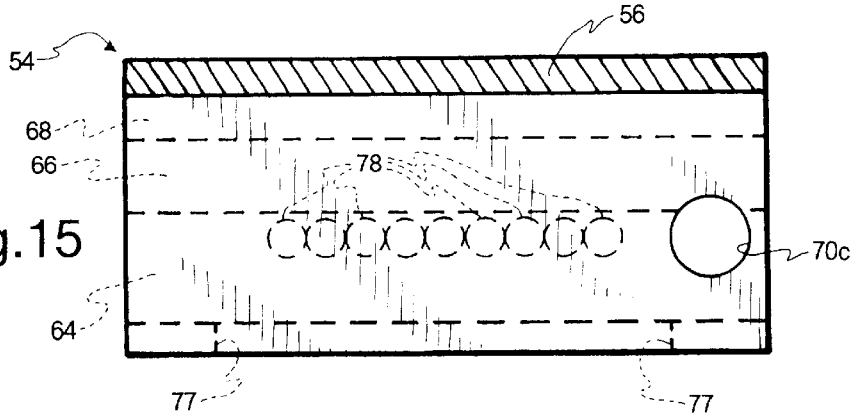
FIG. 15 is a partial left side elevation view, taken along the line 15—15 of FIG. 4, of the base shown in FIG. 12.

Referring still to FIGS. 3–4 and 8–17, the base portion 50 comprises a fore end 52, an aft end 54, and a base plate 56. The entire base portion 50 is mounted inside a corresponding aperture formed in the stock of the firearm (see FIG. 7).

Each base portion 52, 54 comprises uniquely configured receiver areas 58, 60 defined by a bottom wall 62, opposed vertical walls 64, opposed divergingly sloped walls 66, and terminating at a pair of convergingly inclined side walls 68. Each base portion further includes opposed apertures 70*a*, 70*b* and 70*c*, 70*d*, respectively, for receiving the locking screw 100 (described below). Aperture 70*a* includes a female threaded portion to receive a male threaded portion 108 of the locking screw 100. Pairs of mounting apertures 72, 74 extend through the base plate 56 and through one side of each base portion 52, 54 so that fasteners can be inserted into apertures 72, 74 and secure the base 50 to the stock of the firearm.

The base portion 50 further comprises a pair of elongated slots 76 formed in the fore and aft base ends 52, 54, respectively. The purpose of the slot is to allow a compressive force to be exerted on each of the fore and aft receiver areas upon tightening of the locking screw 100 (explained in greater detail below). Enlarged slots 77 (see FIG. 11) allow the shaft portions 32 of the pin assemblies 30 to slide in the vertical direction and in the cast direction relative to the base assembly 50.

Figure 4:
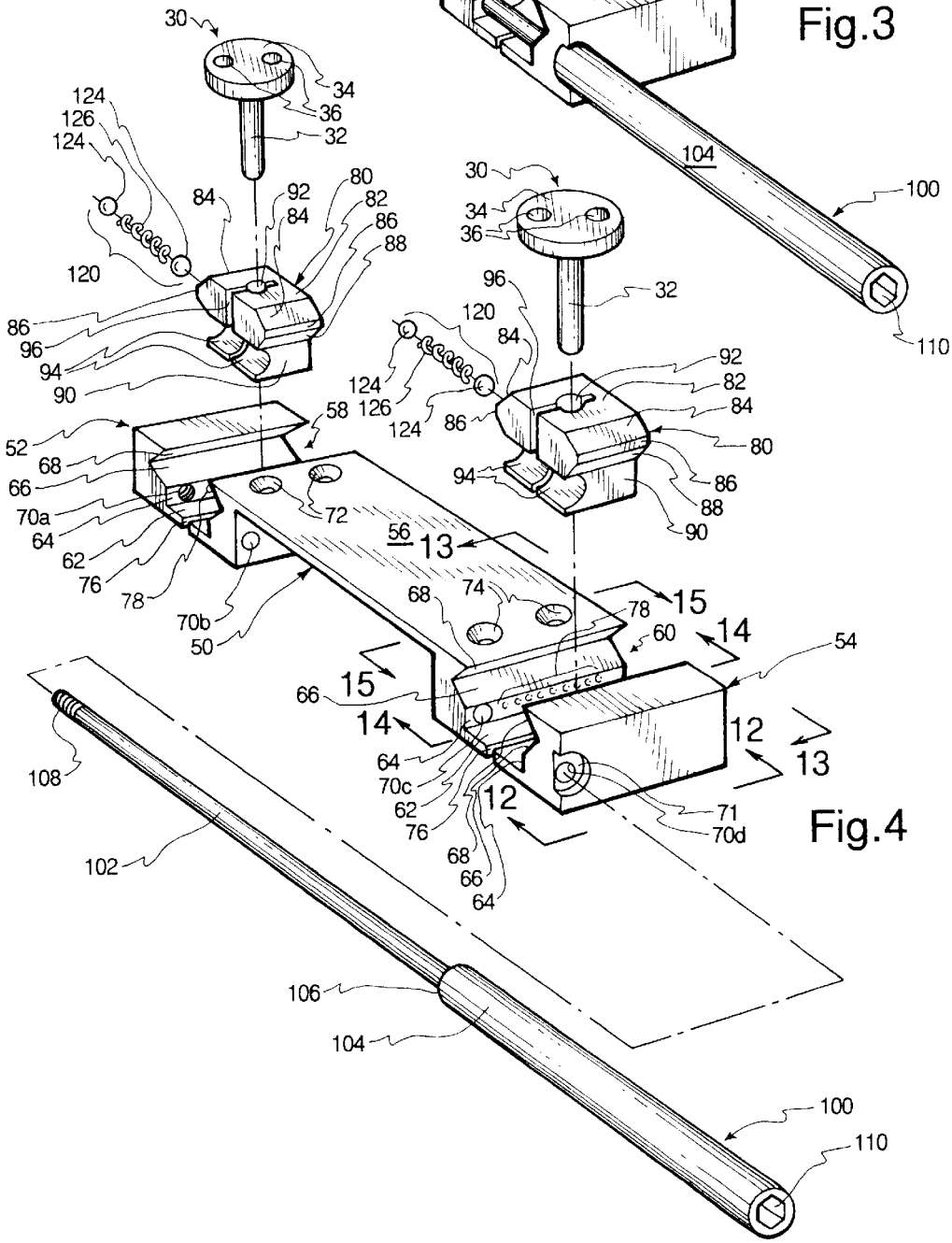
FIG. 4 is an exploded isometric view of the base, the lock mechanisms, the locking screw, and the pins shown in FIG. 3.

Each of the receiver areas 58, 60 further comprise a plurality of detents 78 (only a full set of the detents 78 associated with the aft base end 54 are visible in FIG. 4). The detent system allows the adjustment mechanisms or servo-clamps 80 to be moved in a side-to-side or cast direction. The operation of the adjustable comb assembly and the incremental adjustments that are made possible by the system are explained in greater detail below.

The adjustment mechanisms or servo-clamps 80 are uniquely configured to slide into the fore and aft receiver areas 58, 60, respectively, as shown in FIGS. 3 and 4. The servo-clamps 80 comprise a top surface 82, opposed outward and downwardly sloping surfaces 84, side surfaces 86 which run perpendicular to top surface 82, downwardly sloping walls 88 which converge toward the base of the servo-clamps, and lower sidewalls 90 which also run perpendicular to the top wall 82. A generally circularly cylindrical aperture 92 is formed in each of the servo-clamps. The cylindrical apertures are sized to allow the shaft portions 32 of the pin assemblies 30 to be slidably received. Each servo-clamp further comprises a half-circle slot 94 which allows the servo-clamp to be overlapped with respect to the narrow portion 102 of the locking screw 100 (described in greater detail below). Still further, the servo-clamps each comprise a slot 96 which allows the servo-clamps to be placed under compression to hold the shaft portions 32 of the pin assemblies 30 at a desired vertical adjustment.

Figure 5:
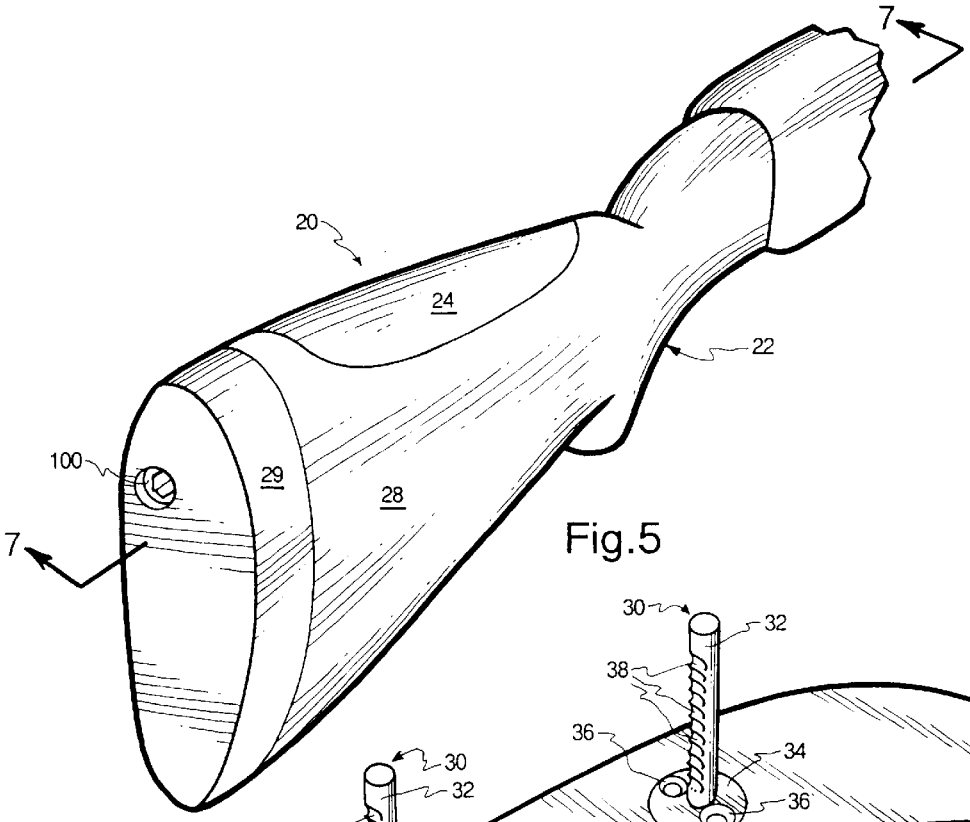
FIG. 5 is an isometric view of the butt end of a firearm showing the location of the locking screw and showing the comb in a fully nested position according to the present invention.

The locking screw 100 (see FIG. 4) comprises a shaft portion of a relatively smaller diameter 102 and a shaft portion of a relatively larger diameter 104. The shaft portion 104 includes an abutment surface 106 which is sized to engage a corresponding abutment surface 71 formed in the base portion adjacent the aft base end 54. The extreme distal end of the locking screw 100 comprises a threaded section 108 which is threadedly received by the aperture 70*a* formed in the fore base end 52 of the base portion 50. An aperture 110 sized to receive a hex-head implement is formed at the proximal end of the locking screw. It should be noted that FIG. 1 shows the locking screw assembly on a firearm without the recoil pad (element 29 in FIG. 5) installed. Upon insertion of the relatively smaller diameter portion 102 of the locking screw through slots 70*d*, 70*c*, 70*b*, and through threaded aperture 70*a*, (see FIGS. 3 & 4) and upon rotating the locking screw 100 in a clockwise direction, the abutment surface 106 engages the surface 71 formed in the base portion 50. This causes, in turn, the space between slots 76 to decrease which causes, in turn, the space between slots 96 in the servo-clamps 80 to decrease to tighten the entire assembly.

Figure 6:
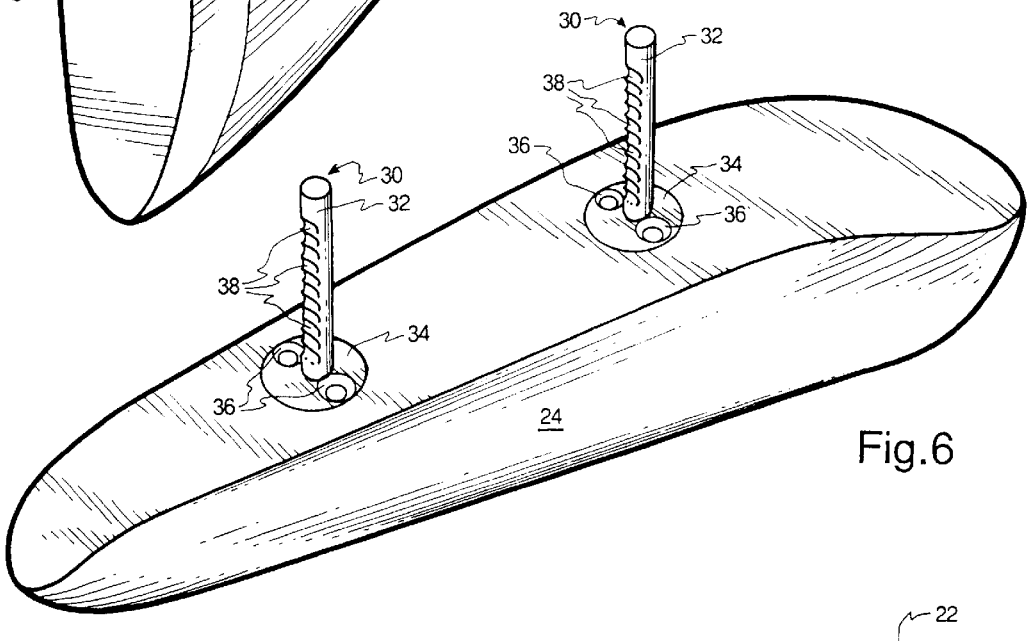
FIG. 6 is a reversed, isometric view of an inverted comb with the adjustment pins secured in place-on the comb according to the present invention.

A detent system is provided in connection with the present invention to allow for incremental adjustments to be made in the vertical direction and in the cast direction. It is to be noted that vertical adjustments can be made independently from cast adjustments and vice versa. The detent system comprises a pair of spring/ball bearing assemblies 120 which are inserted into journaled tubular receiving aperture 122 in the servo-clamp 80 (see FIG. 9). The receiving aperture 122 extends from the lower vertical wall 90 to the central aperture 92. Each spring/ball bearing assembly 120 comprises a pair of ball bearings 124 and a spring 126 positionable between the two ball bearings 124. The ball bearings are sized to fit inside aperture 122 such that one of the ball bearings 124 will protrude into the aperture 92. With reference to FIG. 6, the detents 38 formed in the shaft portion 32 of the pin assembly 30 will engage the ball bearing 124 which extends into the tubular slot 92. On the other side of the spring/ball bearing assembly, the other ball bearing 124 will engage one of the plurality of detents 78 formed in the aft and fore end portions (see FIG. 4 and FIGS. 13–15). This forms the second half of the detent system. Detents 78 and the outermost ball bearing 124 of the spring/ball bearing assembly 120 allow for incremental adjustments in the cast direction (i.e., in the side-to-side direction).

In operation, the adjustable comb apparatus 20 is utilized in the following manner. A firearm 22 is provided (see FIGS. 1, 5, and 7) in which a notched or contoured portion 26 is provided. A comb 24 (see FIGS. 1 and 6) includes a pair of post assemblies 30, which are mounted so that the flange areas 34 are flush with the adjacent surfaces of the comb 24.

A base assembly 50 is provided into which adjustment mechanisms or serv-clamps 80 are slidably inserted into respective receiver areas 58, 60 formed in the base portion. Prior to inserting the servo-clamps 80 into the receiver areas, the spring/ball bearing assemblies 120 are installed into the apertures 122 of the respective servo-clamps 80. The base assembly 50, together with the assembled servo-clamps 80 and the spring/ball bearing assemblies 120, is secured to the firearm stock 28 by inserting appropriate fasteners through apertures 72, 74 (see FIGS. 3 and 4). Thereafter, the locking screw 100 is inserted into the longitudinal aperture 140 formed in the recoil pad 29 and firearm stock 28. The locking screw is inserted sequentially into apertures 70*d*, 70*c*, 70*b*, and 70*a*.

Thereafter, the threaded portion 108 of the locking screw 100 is rotated to engage the threads in aperture 70*a*. This rotation continues in a clockwise manner until the abutment surface 106 of the locking screw 100 engages surface 71 of the base portion 50. Once there has been a slight compressive force placed on the entire adjustable comb assembly, the comb assembly can be adjusted simultaneously in a cast direction and in a vertical direction, simultaneously or independently from one another, similar to what is shown in FIGS. 2*a*–2*e*. It should be understood, however, that additional adjustments above and beyond what is shown in FIGS. 2*a*–2*e* can be made without departing from the scope of the present invention.

After the adjustments have been made in the cast direction and/or in the vertical direction, and the appropriate position of the comb has been achieved relative to the stock of the firearm, the locking screw 100 is further rotated in a clockwise direction to place an increasing compressive force on the receiver areas 58, 60 which place a compressive force, in turn, on servo-clamps 80 to lock the comb in the desired position. Tightening the locking screw 100 will simultaneously prevent movement of the comb apparatus in the vertical direction and in the cast direction. Therefore, only a single locking screw is required to secure the comb in the desired location.

Since the receiver areas 58, 60 place the respective servo-clamps 80 in a compressive force which place the shaft portions 32 of the pin assemblies 30 in a compressive force, no deformation of the materials associated with the adjustable comb apparatus will occur when locking the comb in place. Some of the major benefits associated with the present adjustable comb apparatus according to the invention include the ease and speed with which adjustments can be made in the cast direction and in the vertical direction. Both adjustments can be made simultaneously or independently, and the comb can be locked in position with respect to both directions of adjustment at the same time. In addition, the access opening which allows a hex-head wrench to be inserted into the locking screw is formed at the butt end of the firearm. Thus, minimal external or outside modifications are required to be made in the stock.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications with the proper scope of the appended claims appropriately interpreted in accordance with the doctrine of equivalents.

What is claimed is:

1. An adjustable comb apparatus for a firearm, comprising:

a comb shaped to fit within a notched area formed in a stock of a firearm;

an adjustment mechanism coupled to the comb, the adjustment mechanism allowing simultaneous movement of the comb in a cast direction and in a vertical direction relative to a stock of a firearm;

a lock to secure the comb in a desired location simultaneously with respect to the cast direction and the vertical direction relative to the firearm stock.

2. An adjustable comb apparatus for a firearm according to claim 1, further comprising an extension member coupled to the comb and slidably received by the adjustment mechanism, the extension member allowing for movement of the comb in the vertical direction.

3. An adjustable comb apparatus for a firearm according to claim 1, further comprising a pair of posts coupled to the comb, the adjustment mechanism configured to slidably receive the posts, the posts allowing movement of the comb in the vertical direction.

4. An adjustable comb apparatus for a firearm according to claim 1, further comprising a detent system allowing incremental adjustments to be made in the cast direction and in the vertical direction.

5. An adjustable comb apparatus for a firearm according to claim 1, further comprising a detent system comprising a first set of detents to allow incremental adjustments in the cast direction and a second set of detents to allow incremental adjustments in the vertical direction.

6. An adjustable comb apparatus for a firearm, comprising:

a comb shaped to fit within a notched area formed in a stock of a firearm;

an adjustment mechanism coupled to the comb, the adjustment mechanism allowing simultaneous movement of the comb in a cast direction and in a vertical direction relative to a stock of a firearm;

a lock to secure the comb in a desired location relative to the firearm stock;

a pair of posts coupled to the comb, the adjustment mechanism being configured to slidably receive the posts, the adjustment mechanism allowing the comb to be moved in the cast direction and in the vertical direction, the lock comprising a single locking screw which prevents movement of the comb in the cast direction and in the vertical direction.

7. An adjustable comb apparatus for a firearm, comprising:

a comb shaped to fit within a notched area formed in a stock of a firearm;

an adjustment mechanism coupled to the comb, the adjustment mechanism allowing simultaneous movement of the comb in a cast direction and in a vertical direction relative to a stock of a firearm;

a lock to secure the comb in a desired location relative to the firearm stock;

wherein the lock comprises a single locking screw to secure the comb and prevent movement in the cast direction and in the vertical direction.

8. An adjustable comb apparatus for a firearm according to claim 7, and further comprising an access aperture formed in a butt end of the stock, the single locking screw being accessible via the access aperture.

9. An adjustable comb apparatus for a firearm, comprising:

a comb shaped to fit within a notched area formed in a stock of a firearm;

an adjustment mechanism coupled to the comb, the adjustment mechanism allowing simultaneous movement of the comb in a cast direction and in a vertical direction relative to a stock of a firearm;

a lock to secure the comb in a desired location relative to the firearm stock;

wherein the lock comprises a servo clamp that secures the comb and prevents movement in the cast direction and the vertical direction, the servo clamp securing the comb without any deformation of material.

10. An adjustable comb apparatus for firearms, comprising:

a firearm stock having a notched out portion;

a stock mounting base mounted within the notched out portion of the stock;

a comb positionable within the notched out portion of the stock;

an adjustment mechanism slidably mounted in the stock mounting base, the adjustment mechanism being securable to the comb, the adjustment mechanism allowing the comb to be moveable simultaneously in a cast direction and in a vertical direction;

a lock operatively coupled to the adjustment mechanism, the lock simultaneously securing the comb in a desired position with respect to the cast direction and the vertical direction to prevent movement of the comb relative to the stock.

11. An adjustable comb apparatus for a firearm according to claim 10, further comprising a pair of posts coupled to the comb, the adjustment mechanism configured to slidably receive the posts, the posts allowing movement of the comb in the vertical direction.

12. An adjustable comb apparatus for a firearm according to claim 10, further comprising a detent system allowing incremental adjustments to be made in the cast direction and in the vertical direction.

13. An adjustable comb apparatus for a firearm according to claim 10, further comprising a detent system comprising a first set of detents to allow incremental adjustments in the cast direction and a second set of detents to allow incremental adjustments in the vertical direction.

14. An adjustable comb apparatus for firearms, comprising:

a firearm stock having a notched out portion;

a stock mounting base mounted within the notched out portion of the stock;

a comb positionable within the notched out portion of the stock;

an adjustment mechanism slidably mounted in the stock mounting base, the adjustment mechanism being securable to the comb, the adjustment mechanism allowing the comb to be moveable simultaneously in a cast direction and in a vertical direction;

a lock operatively coupled to the adjustment mechanism, the lock securing the comb to prevent movement in the cast direction and the vertical direction;

wherein the lock comprises a single locking screw to secure the comb and prevent movement in the cast direction and in the vertical direction.

15. An adjustable comb apparatus for a firearm according to claim 14, and further comprising an access aperture formed in a butt end of the stock, the single locking screw being accessible via the access aperture.

16. An adjustable comb apparatus for firearms, comprising:

a firearm stock having a notched out portion;

a stock mounting base mounted within the notched out portion of the stock;

a comb positionable within the notched out portion of the stock;

an adjustment mechanism slidably mounted in the stock mounting base, the adjustment mechanism being securable to the comb, the adjustment mechanism allowing the comb to be moveable simultaneously in a cast direction and in a vertical direction;

a lock operatively coupled to the adjustment mechanism, the lock securing the comb to prevent movement in the cast direction and the vertical direction;

wherein the lock comprises a servo clamp that secures the comb and prevents movement in the cast direction and the vertical direction, the servo clamp securing the comb without any deformation of material.

17. A method of adjusting a comb apparatus for firearms, comprising:

providing a firearm;

providing a comb apparatus adjustably securable to the firearm;

adjusting the comb apparatus simultaneously in a cast direction and a vertical direction;

locking the comb apparatus to prevent movement in the cast direction and in the vertical direction, wherein locking the comb is accomplished by a single locking screw.

18. A method of adjusting a comb apparatus for firearms, comprising:

providing a firearm;

providing a comb apparatus adjustably securable to the firearm;

adjusting the comb apparatus simultaneously in a cast direction and a vertical direction;

simultaneously locking the comb apparatus with respect to the cast direction and the vertical direction to prevent movement of the comb apparatus relative to the firearm.

19. The method of claim 18 wherein locking the comb is accomplished without any deformation of material.

20. The method of claim 18 wherein adjusting the comb apparatus comprises moving the comb apparatus in the cast direction and in the vertical direction at two separate adjustment locations.

21. The method of claim 18 wherein locking the comb apparatus is accomplished by a servo clamp that secures the comb apparatus and prevents movement of the comb apparatus in the cast direction and in the vertical direction.

22. The method of claim 18 wherein adjusting the comb apparatus occurs at a first adjustment location and at second adjustment location, the first adjustment location being independent of the second adjustment location such that adjustments of the comb apparatus in the cast direction and in the vertical direction can be made independently at the first adjustment location and the second adjustment location.

* * * * *